US006837386B1

(12) United States Patent
Kent et al.

(10) Patent No.: US 6,837,386 B1
(45) Date of Patent: Jan. 4, 2005

(54) SPACE SAVING SUPPORT SHELF FOR COLUMN MOUNTING

(75) Inventors: Stephen R. Kent, Bowdoin, ME (US); Richard S. Rendall, Lisbon Falls, ME (US)

(73) Assignee: Aardwolf Integrated Storage Systems, LLC, Bowdoin, ME (US)

( * ) Notice: Subject to any disclaimer, the term of this patent is extended or adjusted under 35 U.S.C. 154(b) by 178 days.

(21) Appl. No.: 10/321,471

(22) Filed: Dec. 18, 2002

(51) Int. Cl.[7] ..... A47F 5/08

(52) U.S. Cl. ..... 211/153; 211/133.4; 211/205; 108/50.12; 108/151

(58) Field of Search ..... 211/107, 133.4, 211/153, 208, 196, 197, 205, 190, 144, 70, 78, 163; 108/50.12, 151, 11, 152, 44, 19, 150, 128; 312/125, 135; 248/218.4, 219.2, 219.3

(56) References Cited

U.S. PATENT DOCUMENTS

| | | | | | |
|---|---|---|---|---|---|
| 96,773 | A | * | 11/1869 | Burnham | 211/107 |
| 221,086 | A | * | 10/1879 | Middleton | 108/151 |
| 423,611 | A | | 3/1890 | Longyear | 211/107 |
| 475,149 | A | * | 5/1892 | Pearson | 126/280 |
| 535,767 | A | * | 3/1895 | Murdock et al. | 108/151 |
| 793,368 | A | * | 6/1905 | Garman | 165/178 |
| 915,737 | A | | 3/1909 | Buckingham | 211/166 |
| 1,017,594 | A | | 2/1912 | Roppeneker et al. | 211/107 |
| 1,350,367 | A | | 8/1920 | Giddings | 211/107 |
| 2,680,668 | A | * | 6/1954 | Stanfiel et al. | 312/305 |
| 2,799,543 | A | | 7/1957 | Tomaselli | |
| 2,826,469 | A | * | 3/1958 | Grant | 220/23.83 |
| 3,000,512 | A | | 9/1961 | Maynor | 211/107 |
| 3,194,403 | A | | 7/1965 | Van Horn, Jr. | 211/166 |
| 3,295,473 | A | * | 1/1967 | Wentworth | 108/152 |
| 3,397,881 | A | | 8/1968 | Hedgecock | 211/166 |
| 3,414,133 | A | * | 12/1968 | Guerri et al. | 211/107 |
| 3,613,896 | A | | 10/1971 | Miller | 211/107 |
| 3,694,046 | A | | 9/1972 | Gehrmann | |
| 3,701,437 | A | * | 10/1972 | Spiik | 211/144 |
| 3,848,943 | A | * | 11/1974 | Geesaman et al. | 312/284 |
| 3,975,068 | A | | 8/1976 | Speckin | 211/107 |
| 4,117,629 | A | | 10/1978 | Ekdahl | 211/107 |
| 4,819,900 | A | | 4/1989 | Funk | |
| 4,953,819 | A | | 9/1990 | Davis | 211/107 |
| 5,197,394 | A | * | 3/1993 | Schmidt | 108/50.12 |
| 5,355,867 | A | | 10/1994 | Hall et al. | |
| 5,522,514 | A | * | 6/1996 | Robinson | 211/188 |
| 5,803,265 | A | * | 9/1998 | Bergerman | 206/557 |
| 5,931,315 | A | * | 8/1999 | Lorentz et al. | 211/40 |
| 5,950,371 | A | | 9/1999 | Rives et al. | 211/107 |
| 6,123,206 | A | * | 9/2000 | Zaremba | 211/107 |
| 6,189,710 | B1 | * | 2/2001 | Mason | 211/131.1 |
| 6,206,493 | B1 | * | 3/2001 | Sanchez-Levin et al. | 312/125 |
| 6,477,966 | B1 | * | 11/2002 | Petryna | 108/11 |
| 6,523,486 | B1 | * | 2/2003 | Plitt et al. | 108/27 |
| 6,539,665 | B1 | * | 4/2003 | Llona | 47/65.5 |
| 6,588,716 | B1 | * | 7/2003 | Heid | 248/125.8 |
| 2002/0162490 | A1 | * | 11/2002 | Petryna | 108/151 |

* cited by examiner

*Primary Examiner*—Jennifer E. Novosad
(74) *Attorney, Agent, or Firm*—Shlesinger, Arkwright & Garvey LLP

(57) ABSTRACT

A space saving support shelf for column mounting comprising pie-shaped segments which may be singularly or plurally attached and interconnected to a lolly-column or the like and wherein such segments are plastic molded in one integral piece for maximum load bearing capacity.

22 Claims, 3 Drawing Sheets

SPACE SAVING SUPPORT SHELF FOR COLUMN MOUNTING

FIELD OF THE INVENTION

This invention relates to a support shelf comprising at least one pie-shaped segment manufactured in one piece from durable and high temperature resistant plastic.

BACKGROUND OF THE INVENTION

Column supported shelving has been utilized for many years as noted by Longyear patent 423,611 of Mar. 18, 1890. Over the years column support shelving for columns such as lolly columns in garages and basements has utilized extensive bracing for heavy loads such as noted in Manor, Speckin and Funk.

Additionally, pole mounted shelving or platforms have been designed for use for example on umbrella stands as shown in Tomaselli; portable grills such as in Hall kitchen units such as Gehrmann; garment and clothes holders such as Buckingham; Geddings and Miller and for pot and medical holding devices such as Ekdahl and Davis; and flower and furniture stands such as Roppeneker et al.; Rives, Hedgecock and Van Horn. All of these devices comprise a plurality of individual parts for assembly. Further, manufacturing the devices requires numerous steps because of individual pieces which have to be separately manufactured.

OBJECTS AND SUMMARY

It is an object of this invention to provide a pie-shaped support shelf for column mounting which may permit mounting of a one pie-shaped segment or a number of pie-shaped segments about a column with means to interconnect pie-shaped segments securely mounted on the column without slippage thereon even under heavy loads.

It is a further object of this invention to provide a support shelf for mounting on a column, post or the like comprising a one piece pie-shaped segment of integral plastic manufacture.

Still a further object of this invention is to provide a pie-shaped segment which can be readily connected to similar segments all of which are of molded composition and all of which are identical so that they can be manufactured by a single mold operation.

Another object of this invention is to provide a support shelf for columns which has high strength load carrying capabilities for use in areas such as garages and cellars for supporting heavy loads such as canoes, kayaks, boat motors and the like.

Yet a further object of this invention is to provide a support shelf for column mounting which permits shipping of individual pie-shaped segments from one manufacturing source.

Still another object of this invention is to provide a high temperature resistant support shelf for columns to minimize danger from fire.

Yet another object of this invention is to provide a support shelf for column mounting which is made from plastic and is designed to have mold release clearances for ease in mold separation.

A further object of this invention is to provide a support shelf for column mounting which is of grill configuration to allow air to circulate through the shelf to permit drying of articles which are wet which may be placed on the shelf.

Yet another object of this invention is to provide a support shelf with means for securing containers beneath the shelf as well as devices which can be hung about the rim of the shelf.

In summary, this invention relates to a one-piece high strength molded support shelf which may be fire resistant and can be readily mounted on a column for heavy loads without slippage of the shelf on the column as will be apparent from the following description and the accompanying drawings which are as follows:

BRIEF DESCRIPTION OF THE DRAWINGS

FIGS. 1–7

In FIG. 1, the support shelf S may comprise of a single pie-shaped segment 2 or a combination of similar segments 4, 6 and 8. The segments 2, 4, 6 and 8 are mounted on a column 10.

Each of the pie-shaped segments may be constructed of materials such as wood, metal and the like, but are preferably injection molded of high density polyethylene or a similar high density plastic material such as those capable of withstanding temperature fluctuations in areas experiencing sever cold or high heat. Such plastics have long life and are not easily subject to ultra violet radiation from the sun which could cause oxidation and weakening of the material by cracks or the like. The segments 2, 4, 6 and 8 are shown as quarter piece segments, which when connected together encompass the column 10. Obviously, the number of pie-shaped segments comprising the support shelf S may vary as to the degrees of arc which an individual pie-shaped segment covers on the support column 10.

Figure 1:
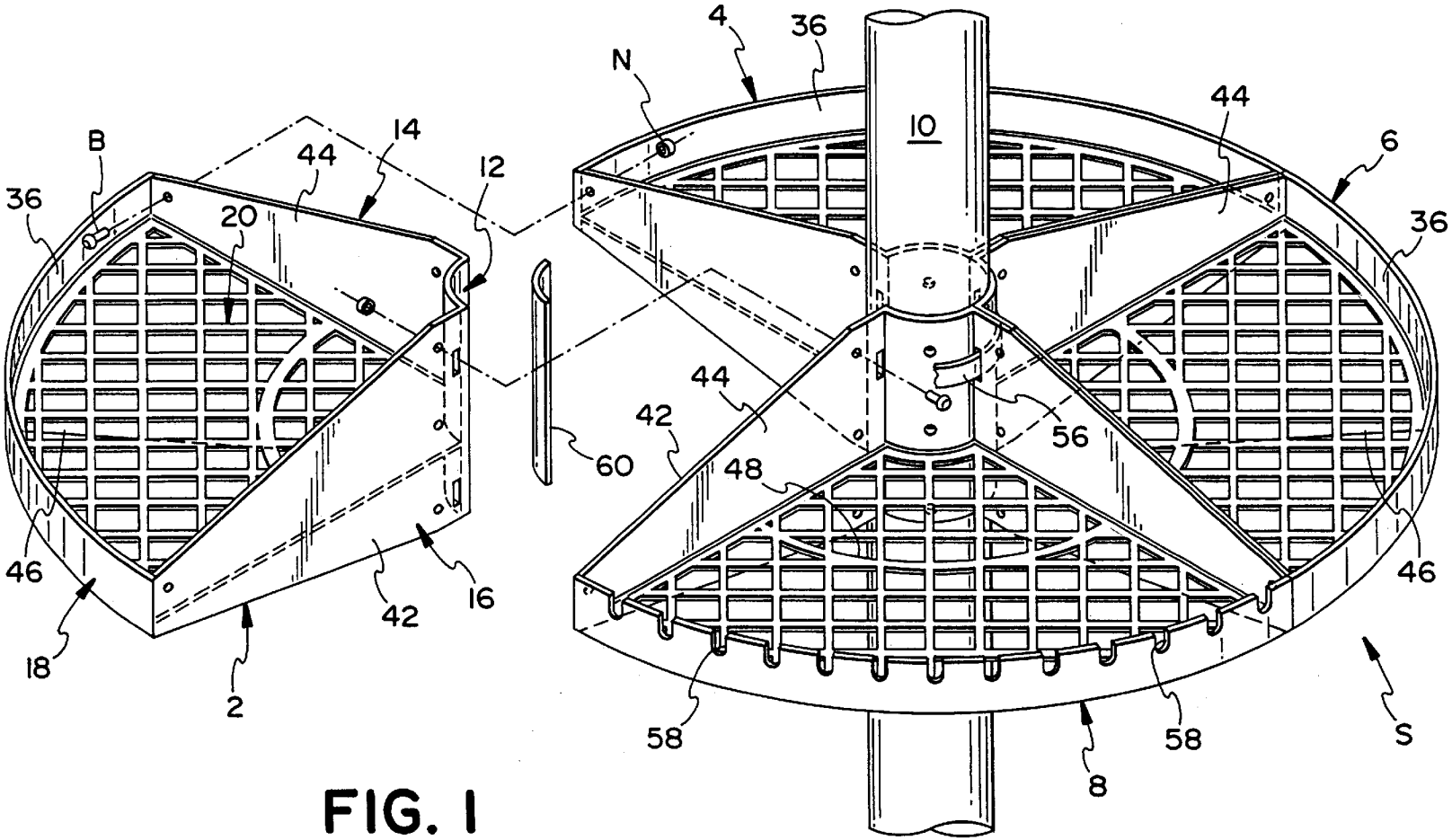
FIG. 1 is a perspective view showing a portion exploded and a portion in fragment.
Figure 2:
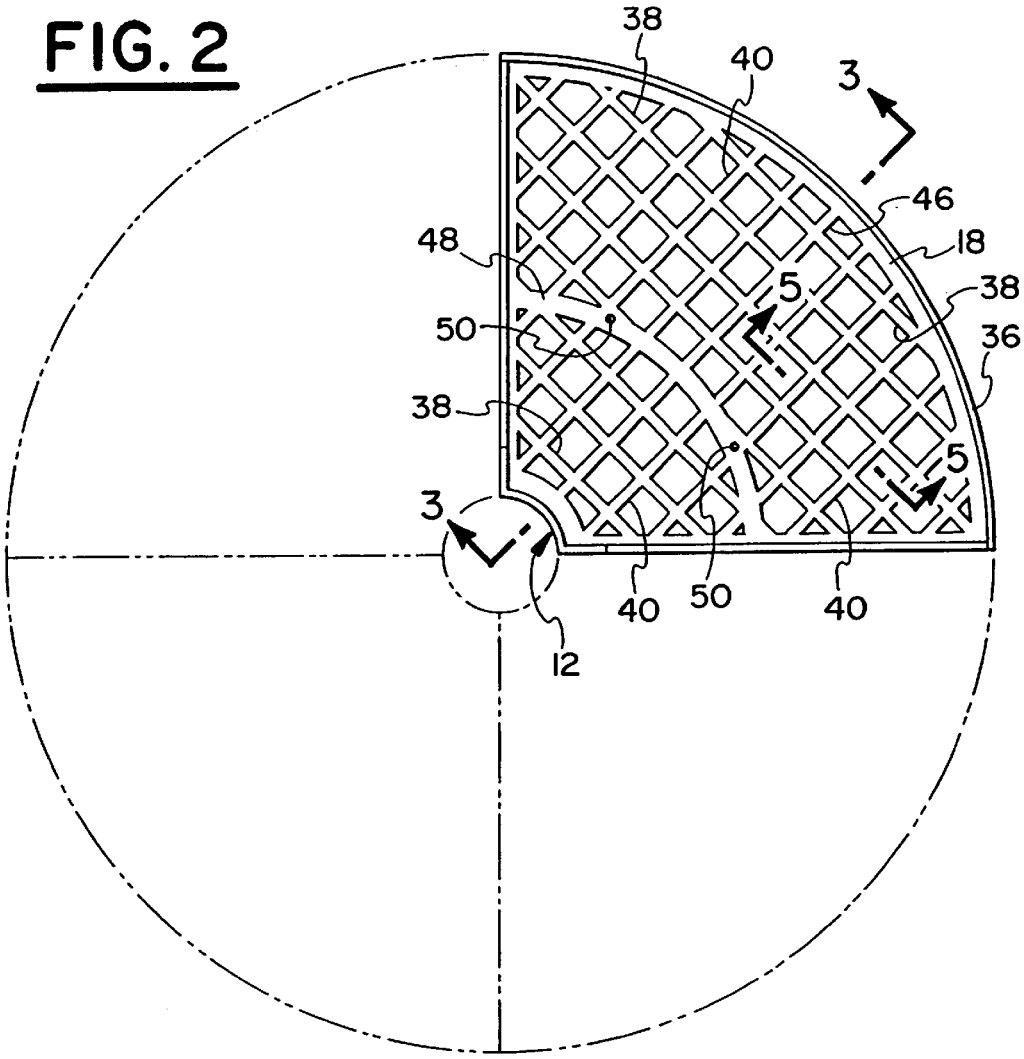
FIG. 2 is a top plan view showing a section positioned in an overall outline of all segments.

Pie-shaped segment 2 is illustrative of the basics of each pie-shaped segment used. Segment 2 includes a front 12, equally-distant right and left side 14 and 16, a back edge 18 and a support platform 20. The support platform 20 includes a top 22 and a bottom 24. The back edge 18 may be an arc as shown in FIG. 1 or a chord or other typical configurations as shown in FIG. 2 in phantom lines.

The front 12 includes upper and lower plates 26 and 28 having screw holes 30, 32 and 34. The upper and lower plates 26 and 28 of the front 12 are concave to receive the column 10 when the support shelf S is mounted thereon.

Figure 3:
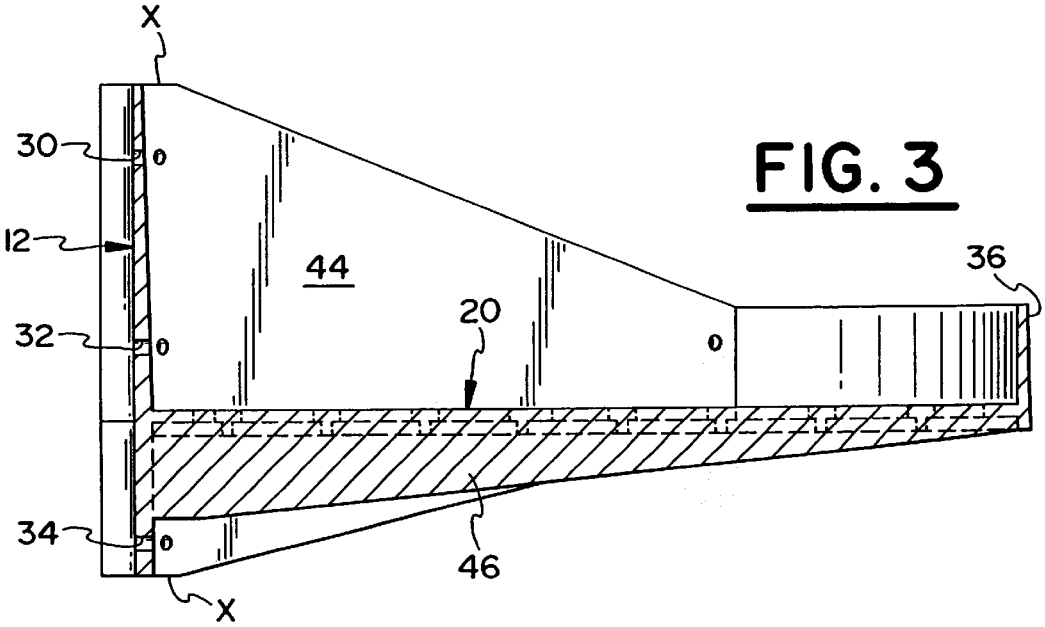
FIG. 3 is a cross section taken along the line 3—3 of FIG. 2 and viewed in the direction of the arrows.

The back edge 18 has an upstanding rim 36 for preventing displacement of articles placed on the support shelf S. The support platform 20 comprises a first series of parallel reinforcing ribs 38 and a second series of parallel reinforcing ribs 40. The first series 38 extends transversely to the second series 40 and primarily at 90 degrees to said second series. The left and right sides 14 and 16 have walls 42 and 44 which extend upwardly and downwardly from the support platform 20. The walls 42 and 44 are designed to prevent buckling as well as to prevent displacement of articles placed on the support platform 20. The reinforcing ribs 38 and 40 are connected to the front 12, back edge 18 and the left and right equally distant sides 14 and 16. The support platform 20 has a central reinforcing member 46 which connects the front 12 to the back edge 18 as best shown in FIGS. 1, and 3. The central reinforcing member 46 is T-shaped and extends below the surface of the support platform 20 and tappers from the front 12 to the back edge 18.

Figure 5:
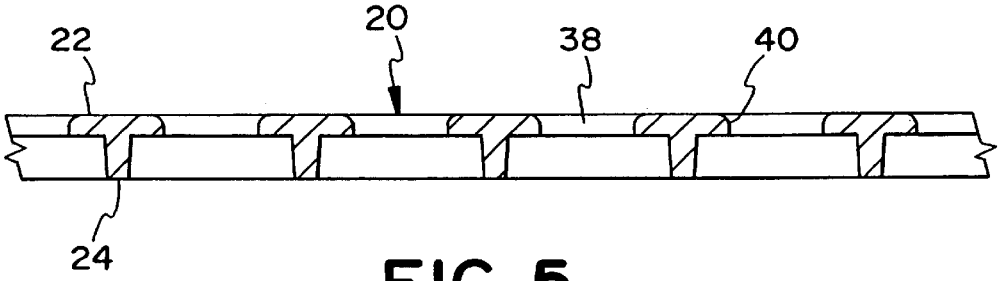
FIG. 5 is a cross section taken along the line 5—5 of FIG. 2 and viewed in the direction of the arrows.

As will be noted in FIG. 5, the ribs 38 and 40 are T-shaped for strength purposes. The ribs 38 are perpendicular to the central reinforcing member 46 and the ribs 40 are parallel to the central reinforcing member 46.

Figure 6:
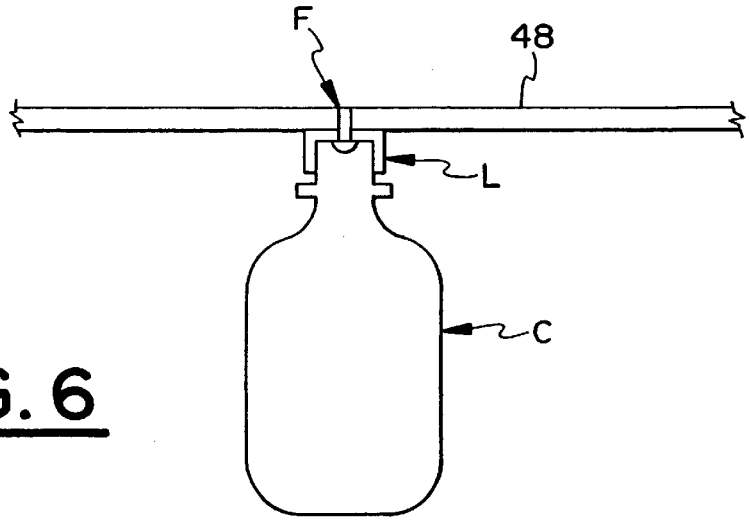
FIG. 6 is a fragmentary elevation of a modification of the arcuate member 48 showing a container mounted thereon.

Between the front 12 and the back edge 18 is an arcuate mounting member 48 as best shown in FIGS. 1 and 6. The mounting member 48 is designed to have screw or support holes 50. The holes 50 allow for a clip or screw F to be inserted therein and downwardly thereof to engage a cover L which will permit a container or jar C to be supported beneath the support shelf S for holding articles such as nails, screws, etc. It may be T-shaped or planar to permit ease in mounting an article. It will be obvious that any type of mounting means can be provided including rivets etc. to the mounting member 48.

Figure 4:
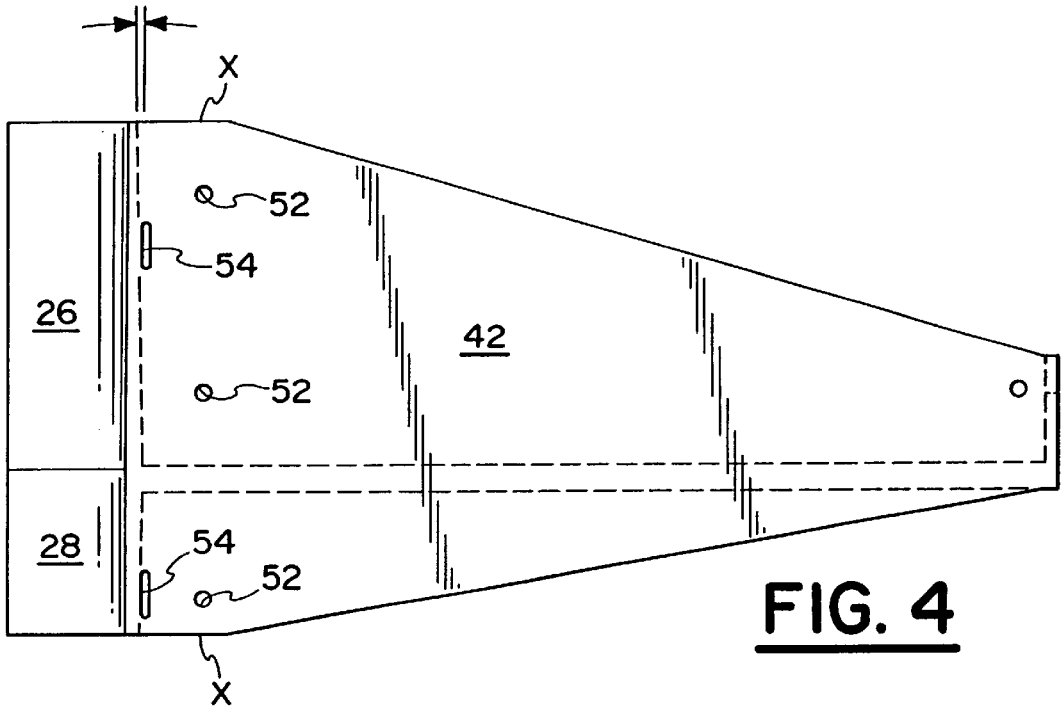
FIG. 4 is a side elevation view of a segment.

As noted in FIGS. 1 and 4, the walls 42 and 44 are provided with fastener holes 52 for securing pie-shaped segments such as 2, 4, 6 and 8 together by means of bolts B and nuts N. Slots 54 are provided for fastener straps 56 as best shown in FIG. 1.

As noted in FIG. 1, rim 36 may be provided with slots 58 for suspending articles therefrom.

In FIG. 1 the front 12 may be provided with an adhesive back foamed strip 60 which grips the column 10 as well as the front 12 upper and lower plates 26 and 28. It should be noted that the walls 42 and 44 taper from the front 12 with the upper portion tapering from adjacent the top of the upper plate 26 of the front 12 to the back edge 18. The walls 42 and 44 at the bottom portion taper from the lower plate 28 of the front 12 upwardly towards the back edge 18. For strength purposes, the walls 42 and 44 adjacent the top of the upper plate 26 and the bottom of the lower plate 28, as noted by X, are horizontal for a short distance prior to the taper. This is also true of the central reinforcing member 46, as noted by X, but the taper of the lower portion of the member 46 does not extend fully to the back edge 18. 46 does not extend to the bottom of 28 to allow for strap 56.

While this invention has been described as having a preferred design, it is understood that it is capable of further modification, uses and/or adaptations following in general the principles of the invention and including such departures from the present disclosure as come within known or customary practice in the art to which the invention pertains, and as may be applied to the essential features set forth, and fall within the scope of the invention or the limits of the appended claims.

What is claimed is:

1. A support shelf for mounting on a column comprising:

a) at least one pie-shaped segment;

b) said at least one pie-shaped segment having a front, right and left sides each having the same length, a back edge, and a support platform having a top and a bottom;

c) said platform comprising spaced reinforcing ribs connecting said front, said back edge and said left and right sides;

d) column mounting means on said front for mounting said support shelf to a column;

e) said back edge having an upstanding rim to prevent displacement of articles placed on said support shelf;

f) said column mounting means extending upwardly from said support platform top and downwardly from said support platform bottom;

g) said left and right sides each having an upwardly extending anti-buckling wall connecting said back edge to said front and to prevent displacement of articles placed on said support shelf; and, h) said left and right sides each having a downwardly extending anti-buckling wall connected to said front and extending toward said back edge.

2. A support shelf for column mounting as in claim 1 and wherein:

a) said platform includes a central reinforcing member extending downwardly and tapering from said front to said back edge, and connecting said front to said back edge.

3. A support shelf for column mounting as in claim 2 and wherein:

a) said spaced reinforcing ribs comprise a first parallel series and a second parallel series; and;

b) said first parallel series runs parallel to said central reinforcing member.

4. A support shelf for column mounting as in claim 3 and wherein:

a) said second series runs perpendicular to said central reinforcing member.

5. A support shelf for column mounting as in claim 1 and wherein:

a) said reinforcing ribs are T-shaped in cross section.

6. A support shelf for column mounting as in claim 1 and including:

a) an arcuate article mounting member extending from said left side to said right side and substantially central of said reinforcing ribs and spaced a substantial distance from said front and said back edge.

7. A support shelf for column mounting as in claim 6 and wherein;

a) said arcuate article mounting member includes mounting means for receiving and suspending an article beneath said support shelf.

8. A support shelf for column mounting as in claim 1 and wherein:

a) said anti-buckling walls have fastener means for connecting similar pie-shaped segments together to increase load carrying capacity up to 360° around a column.

9. A support shelf for column mounting as in claim 1 and wherein:

a) said upstanding rim includes article mounting means.

10. A support shelf for column mounting as in claim 1 and including:

a) an adhesive backed strip for mounting to said pie-shaped segment front to be positioned on said column for preventing slipping of said support shelf on said column when mounted thereon.

11. A support shelf for column mounting as in claim 1 and wherein:

a) said anti-buckling walls each include a tie strap slot adjacent said front for securing said support shelf to a column.

12. A support shelf for column mounting as in claim 1 and wherein:

a) said anti-buckling walls are tapered from said front toward said back edge.

13. A support shelf for column mounting as in claim 12 and wherein:

a) said anti-buckling walls at said front each include a flat portion connected to said taper for added strength at said front.

14. A support shelf for column mounting as in claim 1 and wherein:

a) said at least one pie-shaped segment covers an arc of about 90°.

15. A support shelf for column mounting as in claim 1 and including:

a) a plurality of said pie-shaped segments interconnectable for mounting on a column.

16. A support shelf for column mounting as in claim 1 and wherein:

a) said front includes a concavity for engaging said column.

17. A support shelf for column mounting as in claim 1 and wherein:

a) said front is tapered about 1°for ease in mold release.

18. A support shelf for column mounting as in claim 1 and wherein:

a) said at least one pie-shaped segment is a one piece molded structure.

19. A support shelf for column mounting as in claim 18 and wherein:

a) said one piece molded structure is of a high density thermoplastic.

20. A support shelf for column mounting as in claim 1 and wherein:

a) said spaced reinforcing ribs comprise a first parallel series and a second parallel series, b) said first parallel series extending transversely to said second parallel series.

21. A support shelf for column mounting as in claim 1 and wherein:

a) said back edge is an arc.

22. A support shelf for column mounting as in claim 1 and wherein:

a) said back edge is a chord.

* * * * *